United States Patent [19]

Jedora

[11] 4,120,180

[45] Oct. 17, 1978

[54] MACHINE FOR CLEANING A FABRIC WORKPIECE

[76] Inventor: John J. Jedora, 724 Richelieu St., Timmins, Ontario, Canada, P4N 5G6

[21] Appl. No.: 795,535

[22] Filed: May 10, 1977

[51] Int. Cl.[2] ..... D06B 5/24

[52] U.S. Cl. ..... 68/20; 68/205R; 68/240

[58] Field of Search ..... 68/222, 240, 5 R, 5 A, 68/5 B, 6, 200, 205 R; 134/102, 103

[56] References Cited

U.S. PATENT DOCUMENTS

| | | | |
|---|---|---|---|
| 2,254,691 | 9/1941 | MacLelland | 68/5 A |
| 2,444,728 | 7/1948 | Castoe | 68/240 X |
| 2,586,569 | 2/1952 | Sedgwick | 68/205 R X |
| 3,624,859 | 12/1971 | Folke | 68/240 X |

*Primary Examiner*—Philip R. Coe

[57] ABSTRACT

A machine for cleaning a fabric workpiece, e.g., a so-called spotting machine, operates with a suction nozzle having a screen on which the workpiece is supported. The machine is portable, its casing containing a combination air blower and vacuum pump for generating the suction, and a water tank and pump assembly that provides water under controlled pressure and volume to an applicator tool whereby such water is applied to the workpiece. The size of the screen is restricted to enhance the suction effect, and the pressure of water to the tool is restricted to prevent the splashing of water and dislodged stain particles by controlling the impact velocity. These factors also ensure rapid withdrawal of the water by the suction nozzle and inhibit spreading of the water in the workpiece beyond the area to which it is applied. This process is aided by the shape of the tool which has a flat face for engaging the workpiece and forming a shield around the orifice from which the water flows. The pressure side of the air blower feeds a downwardly directed blowing nozzle situated just above the screen to enhance the drying effect, this air being heated by the blower motor. Solvents other than water can also be used.

9 Claims, 8 Drawing Figures

MACHINE FOR CLEANING A FABRIC WORKPIECE

This invention relates to a machine for cleaning cloth or other fabrics, such as articles of clothing, bedding, upholstery and like household items. In large measure the machine can function as a spot remover, although its usefulness is not restricted to this purpose. The value of the machine is especially evident, however, when it is employed for the removal of localized spots or stains from a piece of cloth, since the machine is designed to act on a comparatively small area of the workpiece at any one time. Of course, a larger area can be covered by performing a series of operations on smaller areas.

Although not limited to any particular size of machine or location of its use, the present invention is especially well suited for embodying in a portable machine, i.e., a machine that is sufficiently small in size and sufficiently self-contained and easy to operate that it could become a commonplace in private homes, along with the sewing machine, washing machine and other domestic appliances that enable the homeowner to undertake tasks that otherwise would have to be taken out to a commercial establishment, in the present instance a dry cleaning establishment.

Commercial scale dry cleaning establishments employ one or more machines that are commonly referred to as "spot removers." After the article to be cleaned has been subjected to the main cleaning process, it is inspected, and any stained areas requiring further treatment are passed to the "spotter" who has various specialized solvents available to him. Typically, he first subjects the stain to water or steam in the hope of removing any foreign substance that is water soluble. If this is unsuccessful he then tries various other detergents and solvents. In performing this operation he may use a vacuum spotting board, for example a board of a type shown in U.S. Pat. No. 2,434,404 issued Jan. 13, 1948 to D. O. Goodwin or U.S. Pat. No. 2,694,914 issued Nov. 23, 1954 to W. C. Glover. The theory behind the use of a vacuum is that the suction it produces will draw out the solvent from the fabric, before it has had a chance to spread outwardly from its area of application. However, in practice the machines available on the market today are not reliable in achieving this objective and frequently the result is the formation of rings around the affected area, which necessitates returning the article to the main cleaning machine for re-treatment. Obviously this is inefficient, and one of the main purposes of the present invention is to provide a vacuum type machine that, when properly used, is much more reliable in avoiding spreading of the solvent with the consequent formation of rings.

It has been determined that the main cause of spreading of the stain or "ringing" is due to the high impact velocity of the steam or water used. While some of the contaminated solvent may be forced through the fabric, a good deal is splashed beyond the area of application, enlarging the stain and producing rings. The present invention affords improvements in this regard by controlling the impact velocity and volume of the solvent, combined with adequate vacuum. By the use of a suitable applicator tool, the basic problem can be solved.

Furthermore, the invention provides a machine that is basically much easier to use than former machines, thus avoiding the need for professional skill and opening the way for the machine to become a household appliance capable of being operated safely and effectively by an inexperienced person. These factors, in turn, provide the opportunity for the machine to be made in a conveniently compact form and hence portable, namely a domestic appliance that can be stored away until needed, like an ordinary vacuum cleaner or floor polisher, and then simply be taken out and plugged in to a power socket, whereupon it is ready for use.

As far as is known, no spotting board or equivalent machine has ever been marketed or even proposed, in the form of a self-contained, protable domestic appliance. The machines in existence have been manufactured for commercial establishments. They have been heavy and bulky machines, usually designed to be installed at a fixed location. Commonly, they have been hooked up to steam, vacuum and air supply lines that emanate from a central source and supply a number of such machines. The avoidance of reliance on a central source has the advantage of reducing the pressure and other fluctuations that one machine can produce in another.

In order to achieve the foregoing objects of the present invention, it provides a machine for cleaning a fabric workpiece, comprising (a) a suction nozzle having a screen for supporting the workpiece horizontally;
(b) means for connecting said nozzle to the suction side of air blowing means;
(c) means for connecting the pressure side of said air blowing means to a downwardly directed blowing nozzle situated above said screen;
(d) a tool for applying water to the workpiece on the screen; and
(e) means for supplying a controlled flow of water under controlled pressure to said tool to control said flow to enable water supplied to a selected area of the workpiece to be rapidly withdrawn by the suction nozzle and to inhibit such water from spreading in or splashing on the workpiece beyond said area.

In a more specific aspect, the invention also provides a portable machine for cleaning a fabric workpiece, comprising (a) a casing;
(b) air blowing means mounted in said casing;
(c) a suction nozzle projecting from the exterior of said casing and having a horizontally extending screen for supporting the workpiece;
(d) means connecting said nozzle to the suction side of said air blowing means;
(e) a downwardly directed blowing nozzle mounted on the exterior of said casing above said screen;
(f) a tool for applying water to the workpiece on the screen, said tool having a flat face for engaging the workpiece, said face forming a shield around an orifice in said face through which the water flows;
(g) a water tank and pump mounted in said casing; and
(h) means connecting the pressure side of said pump to said tool to supply water to said orifice, including means for controlling the velocity and volume of said water to the orifice to restrict said velocity and volume and enable water supplied to a restricted area of the workpiece to be rapidly withdrawn by the suction nozzle and to inhibit such water from spreading in or splashing on the workpiece beyond said area.

DESCRIPTION OF THE DRAWINGS

To provide more specific information, an example of a machine embodying the invention is illustrated in the accompanying drawings and described below.

In the drawings.

DESCRIPTION OF THE PREFERRED EMBODIMENT

Figure 1:
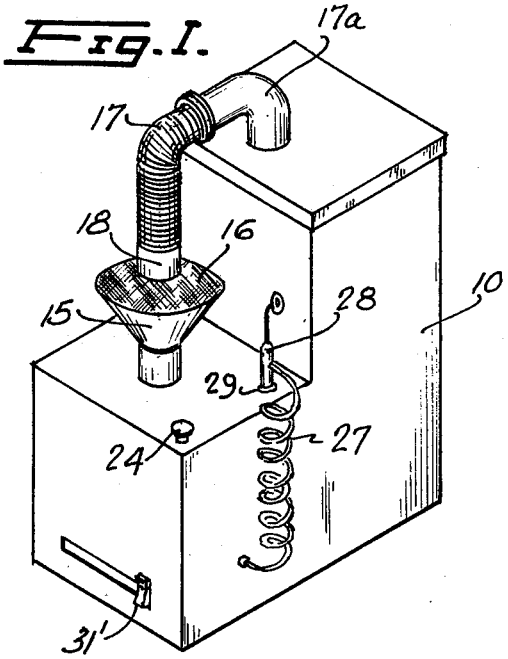
FIG. 1 is a front perspective view of this machine.
Figure 3:
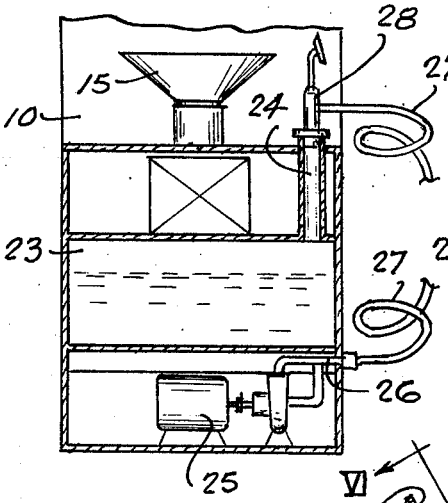
FIG. 3 is a cut away front view of the lower part of the machine of FIG. 1 showing some of the interior mechanisms, this view being taken on III—III in FIG. 4.
Figure 4:
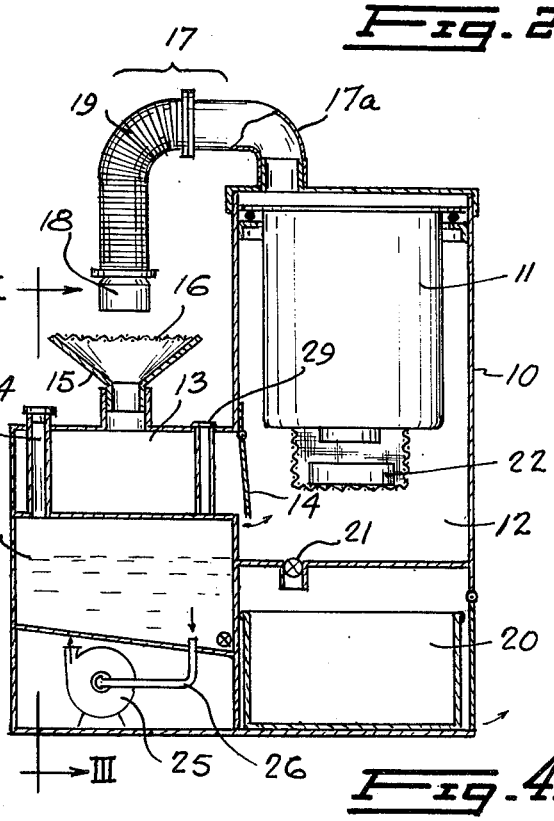
FIG. 4 is a front-to-rear, central, vertical cross-section of the machine showing further internal structures.

As seen in FIGS. 1, 3 and 4 the machine comprises a casing 10 that serves to house an electrically driven, air motor/fan assembly 11 of the type commonly employed in vacuum cleaners, e.g., a half horse power motor that will generate an air flow of 150 cubic feed of air per minute. The suction side of the assembly 11, i.e., space 12 is connected to a suction chamber 13 with a flap valve 14 interposed. The vacuum in the chamber 13 is conveyed to a suction nozzle 15 the upper surface of which takes the form of a horizontal screen 16 of fine wire or nylon mesh. On its pressure side the motor/fan assembly 11 blows air along a hose 17 which terminates in a downwardly directed blowing nozzle 18 situated a few inches above the screen 16. The hose 17 is formed with flexible corrugations 19, so that the nozzle 18 can be moved manually either nearer to or further from the screen 16 as required by the operator.

Since water and other liquid solvents will be drawn into the machine through the suction nozzle 15, a removable drain tray 20 is provided beneath the suction space 12 with a non-return valve 21 interposed to ensure that, when the machine is operating, suction is not lost to the area around the drain tray. A known type of safety float valve 22 is mounted at the intake to the motor/fan assembly 11, in case the water level should rise too high in the space 12.

Due to the obnoxious odor and possibly explosive nature of some cleaning solvents, an absorbent filter such as charcoal can be inserted into the air stream, entering the vacuum side of the machine. Such an absorber could also take the form of a condenser coil, in which the vapours are condensed and led to a closed receiver.

A tank 23 of fresh water is provided in a front cavity of the casing 10, with a filling tube 24 from the exterior. An electrically driven motor/pump assembly 25 located beneath the tank 23 receives water therefrom and discharges it through a pipe 26 to a flexible hose 27 that leads to an applicator 28 which, when not in use by the operator, is mounted in a socket 29 adjacent the suction nozzle 15.

Figure 5:
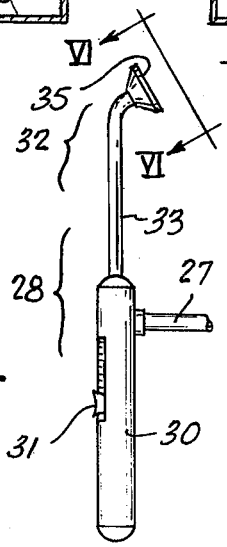
FIG. 5 is a side view of a typical water tool.
Figure 6:
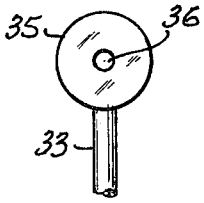
FIG. 6 is a view taken on VI—VI in FIG. 5 on an enlarged scale.

Details of the applicator 28 are shown in FIGS. 5 and 6. It consists of a handle 30 with a variable control knob 31 for controlling the flow of water received from the hose 27 and supplied to the tool 32, i.e., controlling the velocity of such flow. If preferred, this velocity control can be achieved by varying the pump pressure, in which case a suitable control knob 31' for this purpose and accessible from the exterior will be located at a lower forward portion of the casing 10. In this case the knob 31 on the applicator 28 will be a simple on-off switch.

The exact shape of the tool 32 can vary according to the requirements of specific jobs, and, if desired, more than one tool can be supplied with the machine. However, the preferred form of tool consists of a tube 33 the remote end of which is bent at an angle to terminate in an expanded, flat faced circular shield 35 that surrounds a small central orifice 36. The exact shape of the shield is relatively unimportant; it could be oval or square. What is important is that the shield 35 be flat and imperforate and surround the orifice 36 while extending outwardly from the orifice to the extent necessary to inhibit spreading of the water that emerges from the orifice. It will be appreciated that, with the tool 32 pressed down upon a fabric surface, the shield 35 will largely confine the water emerging from the orifice 36 to prevent splashing and to prevent water moving outwardly along the surface of the fabric.

In terms of removing the soiling from the material a comparatively high velocity jet of water is desirable. However, such velocity can cause splashing and spreading of water from the soiled area, with consequent undesirable water marks on the material. The use of the shield 35 thus has the advantage that it enables use of a higher velocity jet of water than would be acceptable if there were no shield.

Figure 7:
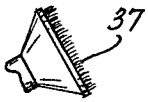
FIG. 7 is a variant of the tool seen in FIG. 6.

FIG. 7 shows an alternative in which the flat face of the shield 35 is fitted with bristles 37 which can be used to brush the surface of the material being cleaned at the same time as the water is applied. The presence of these bristles does not prevent the shield 35 continuing to act as a shield in inhibiting the outward flow of water.

Figure 2A:
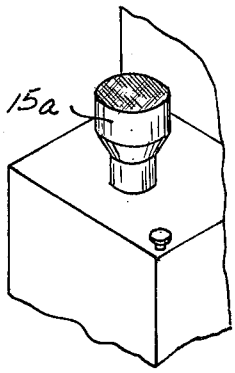
FIGS. 2*a* and 2*b* are fragments of FIG. 1 showing alternative suction nozzles.
Figure 2B:
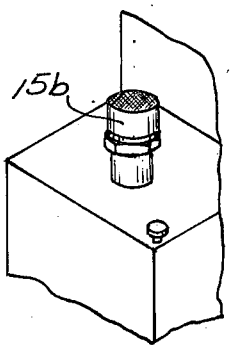

The screen of the suction nozzle 15 shown in FIG. 1 is comparatively large, having typically a diameter of about 5 inches. It is often desirable to use smaller diameter nozzles in order to concentrate the suction, and to meet this need the machine is so constructed that the nozzle 15 can simply be removed by hand and replaced by a smaller one. FIGS. 2*a* and 2*b* show replacement nozzles 15*a* and 15*b* with 3½ inches and 2½ inches diameter screens, respectively, which can be used. The following test figures show the greatly enhanced suction effect that can be obtained in this way, using a ½ H.P. motor which yielded a vacuum of 1.5 inches of mercury and 150 cubic feet of air per minute. The air velocity through the empty screens (no fabric in place) was 1110 feet per minute for nozzle 15, and 1500 and 2030 feet per minute, respectively, for the smaller nozzles 15*a* and 15*b*. When a comparatively porous fabric was placed over each screen, i.e., a section of a double knit garment, these velocities were reduced to 970, 1400 and 1980 feet per minute, respectively. With a less porous article, i.e., a piece of 50/50 polyester-cotton sheeting, placed over each nozzle the velocities were further reduced to 770, 1000 and 1170 feet per minute, respectively.

Looked at another way, since the screens of the nozzles 15, 15*a* and 15*b* have approximately 20; 9.5 and 5 square inches, respectively, the flow rates in cubic feet per square inch per minute were found to be 7.3; 15.3 and 28, respectively, for the double knit fabric, and 4.3; 9.0 and 11.3, respectively, for the less porous sheeting.

The advantage of using the smaller nozzles for all types of fabric will thus be apparent, as far as the air velocity and flow rates are concerned. On the other hand, a larger nozzle has the advantage of permitting the operator to work with a larger area of an article at one time. The smaller nozzles are also necessary for cleaning the fabric in confined areas, such as a sleeve of a jacket.

In operation and with the motors running, the fabric surface to be cleaned is placed over the screen 16 of whichever sized nozzle has been chosen. The operator then uses the applicator 28 to apply a controlled amount of water to a selected area of the fabric with the tool 32 pressed gently down on such area. This selected area is substantially smaller than the entire area of the workpiece (fabric) extending over the screen 16. If the affected area is larger than the shield 35, i.e., larger than such a selected area the tool will have to be moved over the affected area. During such operation the shield 35 serves also to apply a small amount of rubbing action to the affected area, especially if the tool shown in FIG. 7 is employed.

Of great importance is that the amount and velocity of the water applied must be restricted, being of such small values that, for the conditions prevailing, e.g., the size of nozzle, porosity of the workpiece and other parameters, the suction air can remove the water or other solvent almost immediately and, in particular, before it can have had time to spread and form the undesirable rings that have proved such a problem, even with professional operators, in the past. High impact velocity can also cause splashing of the water and dislodged particles beyond the original stained area. The provision of effective and convenient means for controlling, and particularly, restricting, the water flow and velocity applied to the workpiece is thus an important aspect of the machine.

Of equal importance to this restriction of the water flow to the workpiece is the maintenance of a correspondingly high rate of withdrawal of such water by means of a high suction rate in terms of cubic feet per square inch per minute. As has been demonstrated above, the nozzles with smaller diameter screens are better in this regard. However, provided the water input is carefully controlled, the largest screen provided, i.e., 5 inch diameter, can be effectively used. This is about as large a nozzle area, i.e., approximately 20 square inches, as can be tolerated, without increasing the size of the vacuum motor, which is undesirable for a portable machine. The motor of the present machine provides 150 cubic feet per minute (with no fabric in place) which, for 20 square inches, is 7.5 cubic feet per square inch per minute. While there is, of course, no exact cut-off point, the machine of the present invention should operate with a suction nozzle screen that is sufficiently restricted in size relative to the power of the vacuum motor that the air flow when the nozzle is unobstructed is no less than approximately this value of 7.5, bearing in mind that this value will be reduced in practice by the resistance of the fabric.

If it is be found that water does not remove the stain, a detergent solution or one of a number of other solvents can be tried. These other liquids can be kept in handy squeeze bottles and applied by hand to the affected area, either through a simple nozzle or through a tool of the type shown in FIGS. 5 and 6. Another alternative is to supplement the tank 23 with further tanks in the casing 10 containing the other solvents and to arrange for the pump to be switched at will to one or other of these tanks.

The quick drying action of the present machine is aided by the return air or "blower" portion that consists of the hose 17 and nozzle 18. Although not normally necessary, because the blower output air is heated to some extent by passing through the motor, this return air could be passed over a heating coil to give it additional drying power. Since the air is heated by being passed over the motor, the motor is correspondingly cooled by the air.

During the application of water or other solvent to the area to be cleaned the nozzle 18 is moved aside by the operator (the fitting **17*a* pivoting about a vertical axis on the casing 10), to enable full access to the material spread over the screen 16**. Once the spotting operation is complete, the nozzle is swung back to its central position to aid the drying process.

It will be apparent that the machine that has been described has many practical advantages over the comparatively cumbersome machines employed in the past, particularly those that have used steam. The present machine avoids the use of steam which often proves to be too hot and can distort or destroy many fabrics. Steam has the disadvantage that it often serves to set rather than remove the stain. It may also act to bleed dyes out of the fabric, or even to melt or partly melt synthetic materials in fabrics. By contrast, water can make intimate contact with the fabric. It also permits use of an applicator tool with a shield, with the advantages already described, which would be impossible using steam. It is also much easier with water to ensure the very careful control over the amount that is applied to the affected area, as is necessary to insure that the withdrawal of water takes place at such a rate that the supply of water (or other solvent) never exceeds withdrawal capacity. This relationship is the key to the avoidance of ringing of the workpiece around the affected area.

The use of water instead of the conventional steam also greatly simplifies the apparatus, avoiding the need for a steam generator (boiler) and making it feasible for the machine to be constructed on a portable scale for use as a household appliance.

While the machine illustrated is equipped with its own air fan and motor, thus providing a self-contained unit, it is within the invention to provide a simplified version having fittings adapted to be connected to the intake and pressure sides of an ordinary domestic or commercial vacuum cleaner. Indeed, other variations to the specific construction and arrangement of parts will be possible within the scope of the present invention as defined by the claims that follow.

For example, and, as a further alternative, the machine when used as a household applicance may be installed in the same style as a dishwasher or clothes washer, i.e., with its water taken from a main supply. This would eliminate the need for a water tank and for a pump, assuming there were sufficient pressure in the main supply.

I claim:

1. A machine for cleaning a fabric workpiece, comprising (a) a suction nozzle having a screen for supporting the workpiece horizontally;

(b) air blowing means including a motor and a fan;

(c) means for connecting said nozzle to the suction side of said air blowing means for drawing air through said nozzle and past said motor for thereby cooling said motor and heating said air;

(d) means for connecting the pressure side of said air blowing means to a downwardly directed blowing nozzle situtated above said screen;

(e) a tool for applying water to a selected area of the workpiece on the screen, said selected area being substantially smaller than the entire area of the workpiece on the screen; and (f) means for supplying a controlled flow of water under controlled pressure to said tool to control said flow to enable water supplied to said selected area of the workpiece to be rapidly withdrawn through the suction nozzle by said air to inhibit such water from spreading in and splashing on the workpiece beyond said selected area.

2. A machine according to claim 1, wherein the area of the screen of said suction nozzle is sufficiently small that, in the absence of the workpiece, air flow through the screen will be no less than approximately 7.5 cubic feet per square inch per minute.

3. A machine according to claim 1, wherein said tool has a face for engaging the workpiece, said face having a central orifice therein surrounded by an imperforate shield portion extending outwardly from the orifice to inhibit outward spreading of water from the orifice when the tool is pressed down against the workpiece.

4. A portable machine for cleaning a fabric workpiece, comprising:

(a) a casing;

(b) air blowing means including a motor and a fan mounted in said casing;

(c) a suction nozzle projecting from the exterior of said casing and having a horizontally extending screen for supporting the workpiece;

(d) means connecting said nozzle to the suction side of said air blowing means for drawing air through said nozzle and past said motor for thereby cooling said motor and heating said air;

(e) a downwardly directed blowing nozzle mounted on the exterior of said casing above said screen and connected to the pressure side of said air blowing means;

(f) a tool for applying water to a selected area of the workpiece on the screen, said selected area being substantially smaller than the entire area of the workpiece on the screen, said tool having a face for engaging the workpiece, said face forming a shield around an orifice in said face through which the water flows;

(g) a water tank and pump mounted in said casing; and (h) means connecting the pressure side of said pump to said tool to supply water to said orifice, including means for controlling the velocity and volume of said water to the orifice to restrict said velocity and volume and enable water supplied to said selected area of the workpiece to be rapidly withdrawn through the suction nozzle by said air to inhibit such water from spreading in or splashing on the workpiece beyond said area.

5. A machine according to claim 4, wherein said air blowing means delivers approximately 150 cubic feet per minute and the area of said screen is approximately 20 square inches.

6. A machine according to claim 4, wherein said air blowing means delivers approximately 150 cubic feet per minute and the area of said screen is approximately 9.5 square inches.

7. A machine according to claim 4, wherein said air blowing means delivers approximately 150 cubic feet per minute and the area of said screen is approximately 5 square inches.

8. A machine for cleaning a fabric workpiece, comprising (a) a suction nozzle having a screen for supporting the workpiece horizontally;

(b) means for connecting said nozzle to the suction side of air blowing means;

(c) a tool for applying water to the workpiece on the screen, said tool having a face for engaging the workpiece, said face having a central orifice therein surrounded by a flat imperforate shield portion extending outwardly from the orifice to inhibit outward spreading of water from the orifice when the tool is pressed down against the workpiece; and (d) means for supplying a controlled flow of water under controlled pressure to said tool to restrict said flow to enable water supplied to a selected area of the workpiece to be rapidly withdrawn through the suction nozzle to inhibit such water from spreading in or splashing on the workpiece beyond said area, said selected area being substantially smaller than the entire area of the workpiece on the screen.

9. A machine for cleaning a fabric workpiece, comprising:

(a) a suction nozzle having a screen for supporting the workpiece horizontally;

(b) means for connecting said nozzle to the suction side of air blowing means;

(c) means for connecting the pressure side of said air blowing means to a downwardly directed blowing nozzle situated above said screen;

(d) a tool for applying water to a selected area of the workpiece on the screen, said selected area being substantially smaller than the entire area of the workpiece on the screen; and (e) means for supplying a controlled flow of water under controlled pressure to said tool to control said flow to enable water supplied to said selected area of the workpiece to be rapidly withdrawn through the suction nozzle by said air to inhibit such water from spreading in and splashing on the workpiece beyond said selected area.

* * * * *